US005802620A

United States Patent [19]

Chiang

[11] Patent Number: 5,802,620

[45] Date of Patent: Sep. 8, 1998

[54] SWIMMING GOGGLE STRUCTURE

[76] Inventor: Herman Chiang, 1079 Lancer Dr., San Jose, Calif. 95129

[21] Appl. No.: 713,750

[22] Filed: Sep. 13, 1996

[51] Int. Cl.[6] ..... A61F 9/02

[52] U.S. Cl. ..... 2/428; 2/439; 2/445; 2/452

[58] Field of Search ..... 2/428, 429, 430, 2/440, 452, 426, 445, 446; 351/43

[56] References Cited

U.S. PATENT DOCUMENTS

| | | | |
|---|---|---|---|
| 1,742,412 | 1/1930 | O'Flanagan | 2/440 |
| 2,150,791 | 3/1939 | Welsh | 2/440 |
| 3,457,564 | 7/1969 | Holloway | 2/452 X |
| 3,605,116 | 9/1971 | Simpson et al. | 2/445 |
| 5,524,300 | 6/1996 | Chiang | 2/445 X |
| 5,555,571 | 9/1996 | McCaffrey | 2/452 X |
| 5,596,771 | 1/1997 | Hsu et al. | 2/428 |

*Primary Examiner*—Peter Nerbun
*Attorney, Agent, or Firm*—Pro-Techtor International

[57] ABSTRACT

A swimming goggle structure includes two frames each having a lens fixed therein with a bridge connecting between inner sides of the frames. The bridge comprises a bendable insert embedded therein and substantially extending across the bridge to provide conformity of the bridge to a wearer's nose contour.

10 Claims, 8 Drawing Sheets

SWIMMING GOGGLE STRUCTURE

FIELD OF THE INVENTION

The present invention relates to swimming goggles and in particular to a swimming goggle structure having integrally formed lens frames, bridge and gaskets with a bendable or pliable insert fixed in the bridge to provide a better nose conformity and to allow the goggle frame to be made with a softer material to provide enhanced comfort of wearing the swimming goggles.

BACKGROUND OF THE INVENTION

Swimming goggles with single piece frame are known, such as Taiwan utility model No. 93080 filed on Jan. 12, 1994 by the present applicant. The Taiwan utility model provides a novel design and modifications on the bridge, the lens frames and the gasket of the goggle structure in order to allow these portions of the goggle structure which require different flexibility and softness to be integrally formed with the same soft material without water leakage in use under water. The Taiwan utility model is shown in FIGS. 1A to 1C wherein the goggle structure comprises a bridge 60 which has a cross section having a center portion thicker than the sides (see FIG. 1A) in order to provide the bridge which is made of a soft material with a great resistance to stretching. The gaskets 61 (see FIG. 1B) of the goggle structure are formed as integral parts of the frames 62. The lens frames 62 are each provided with a connecting hole 621 and a constraining projection 622 outboard the connecting hole 621 (see FIG. 1C). The fastener 63 of the head strip comprises a retaining tab 631 extending therefrom to engage the connecting hole 621 and abut against the lens frame 62. With such an arrangement, the Taiwan utility model allows the lens frames, the gasket and the bridge to be integrally formed with the same material of suitable softness, while prohibiting the lens frames and the bridge from being stretched to deform or distort by pulling the head strip during wearing the goggles.

The bridge of the above-discussed conventional goggle structure, although to some extent capable to resist stretching, yet needs quite a thickness in order to resist stretching to a satisfactory extent. This makes it impossible to fully conform to the wear's nose contour and causes irritation to the nose when wearing the goggles.

The problem of conforming the bridge to the wearer's nose also occurs in other conventional goggle structures, such as those shown in FIGS. 2 and 3. In the goggle structure 5 shown in FIG. 2, the bridge 50 is integrally formed with the lens frames so that no adjustment of the bridge 50 is possible. Further, to provide a secure sealing effect and to prevent deformation during wearing, the goggle structure 5 has to be made of a rigid material so that it is uncomfortable to wear such goggles. Further, a bridge made of the rigid material is easy to break.

The conventional goggle structure 5' shown in FIG. 3 provides a bridge strip 50' separate from the lens frames of the goggles so as to allow adjustment of the goggles to satisfy different wearers. Such a separate bridge strip needs to be additionally mounted to the frames to construct the goggles. This increases the cost. Furthermore, the adjustment provided by such a separate bridge strip is not fully satisfactory.

It is therefore desired to provide a goggle structure with better adjustability and enhance comfort so as to overcome the drawbacks of the prior art goggle structures.

OBJECTS OF THE INVENTION

Therefore, an object of the present invention is to provide a goggle structure comprising a pliable or bendable bridge insert which is capable of plastic deformation so as to completely conform to the contour of a wearer's nose.

Another object of the present invention is to provide a goggle structure which is integrally made of a soft material with a stretching resisting member fixed inside the bridge to provide the goggle structure with a soft and comfortable gasket while the bridge is strong enough to resist the stretching occurring thereon during wearing the goggles.

To achieve the above objects, the present invention is featured in that a goggle structure comprises a bendable or pliable insert within the bridge and substantially straddling between the frames which is capable of plastic deformation to allow the bridge to bend and deform to any desired configuration, providing better conformity to the wearer's nose contour, while maintaining resistance to the stretching force applied thereto during wearing the goggles.

In an aspect of the present invention, the bendable insert is made of a deformable metal plates, such as copper or copper based alloys, aluminum or aluminum based alloys; plastic-deformable rubbers or plastics, such as silicon rubber, natural rubber or injection moldable plastics, for example polyvinylchloride (PVC), polypropylene (PP) and nylon.

In accordance with another aspect of the present invention, the bendable insert within the bridge comprises a hollow frame-like member substantially straddling between the lens frames with an concave arcuate cushion pad extending inward from the hollow section of the frame-like insert to provide a cushion for the wearer's nose.

The present invention will be better understood from the following description of preferred embodiments thereof with reference to the attached drawings, wherein:

DETAILED DESCRIPTION OF THE PREFERRED EMBODIMENT

Figure 1A:
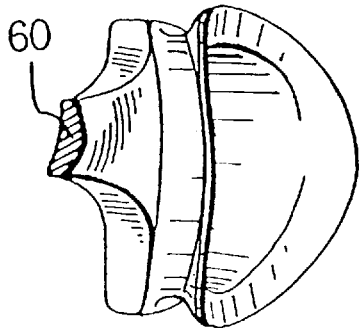
FIGS. 1A and 1B shows different portions of a conventional goggle structure.
Figure 1B:
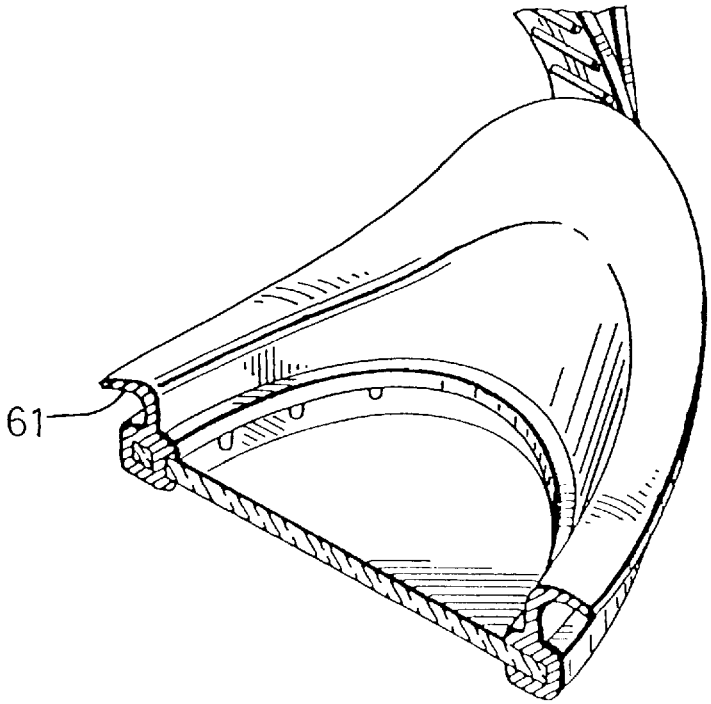
Figure 1C:
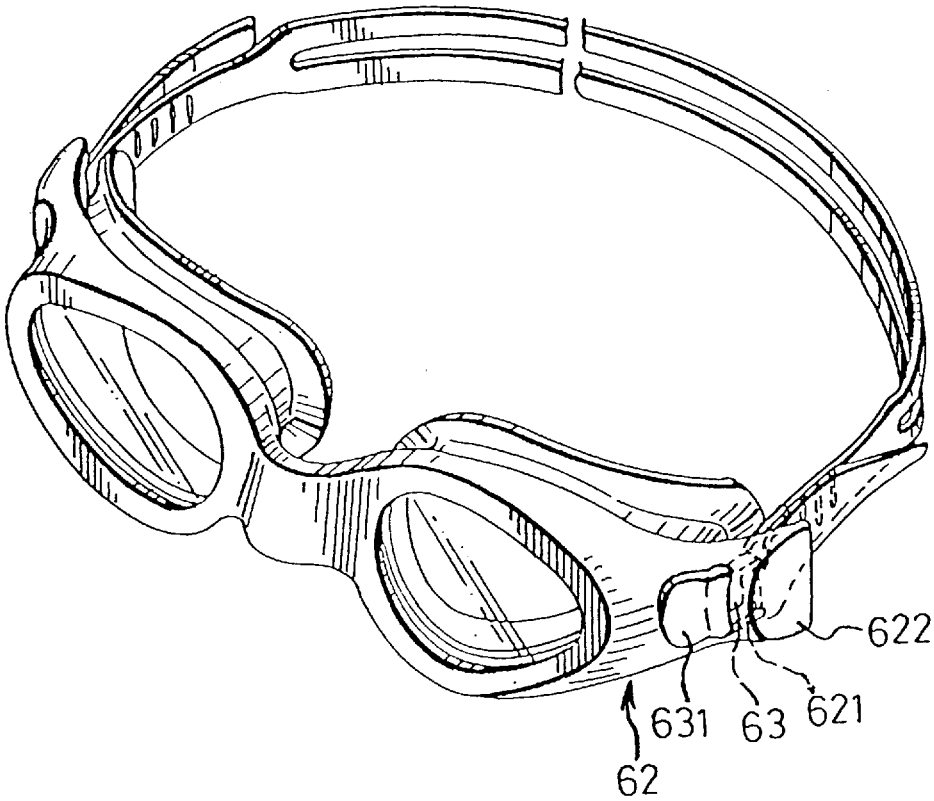
FIG. 1C shows a perspective view of the conventional goggle structure.
Figure 2:
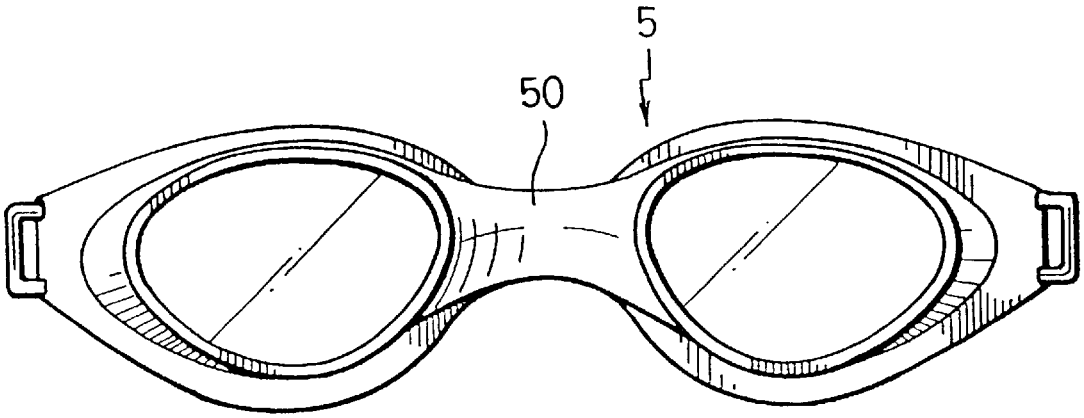
FIG. 2 is a front view of another conventional goggle structure.
Figure 3:
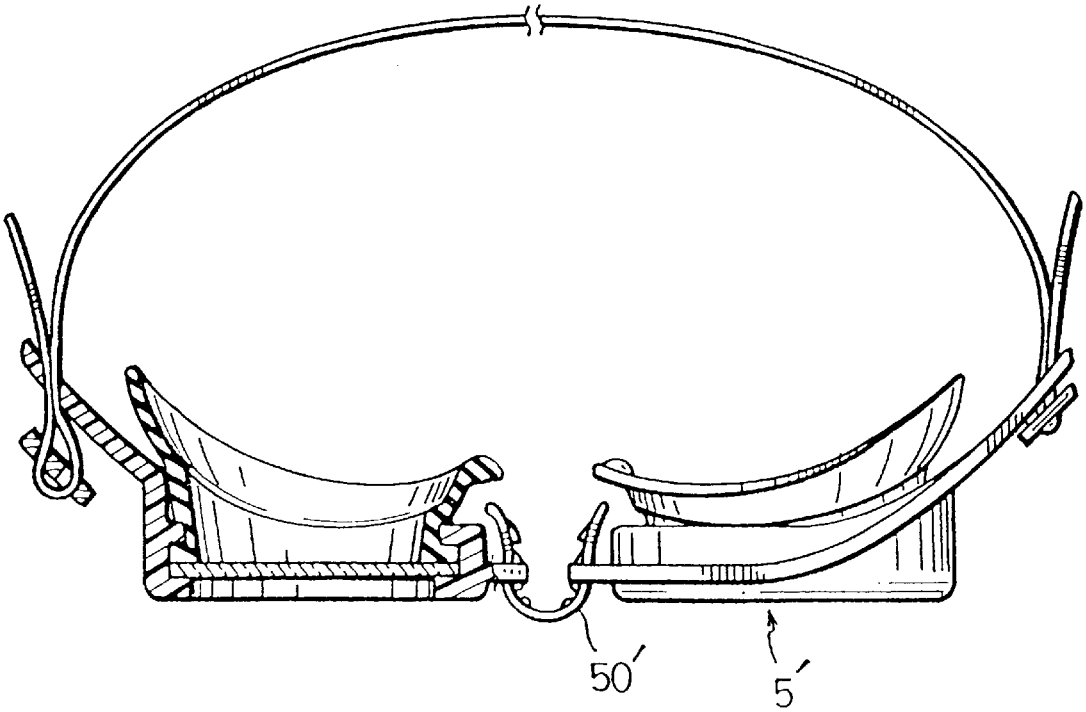
FIG. 3 is a top view, partially broken, showing a further conventional goggle structure.
Figure 4:
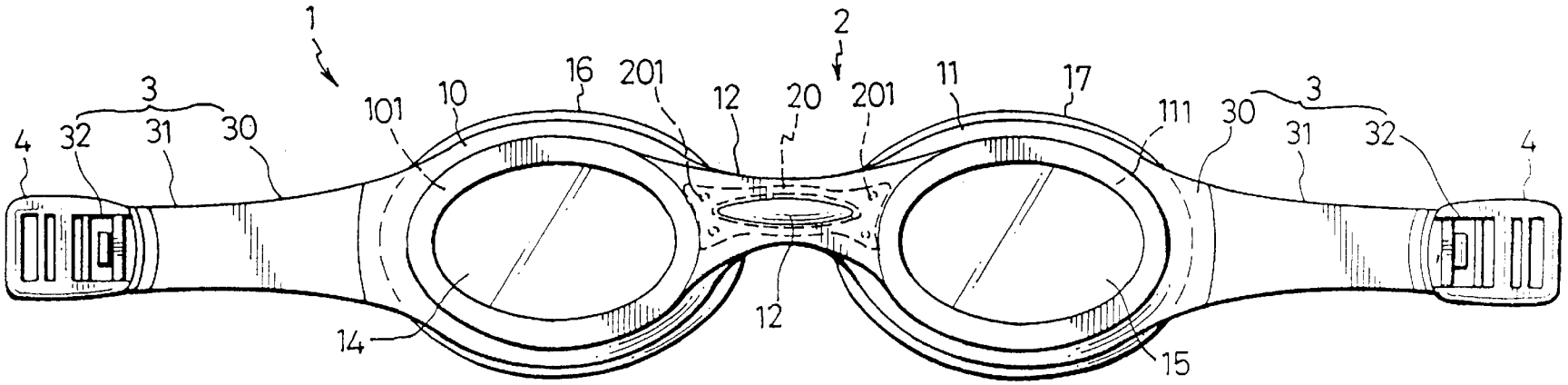
FIG. 4 is a front view of goggles constructed in accordance with a first embodiment of the present invention.
Figure 5A:
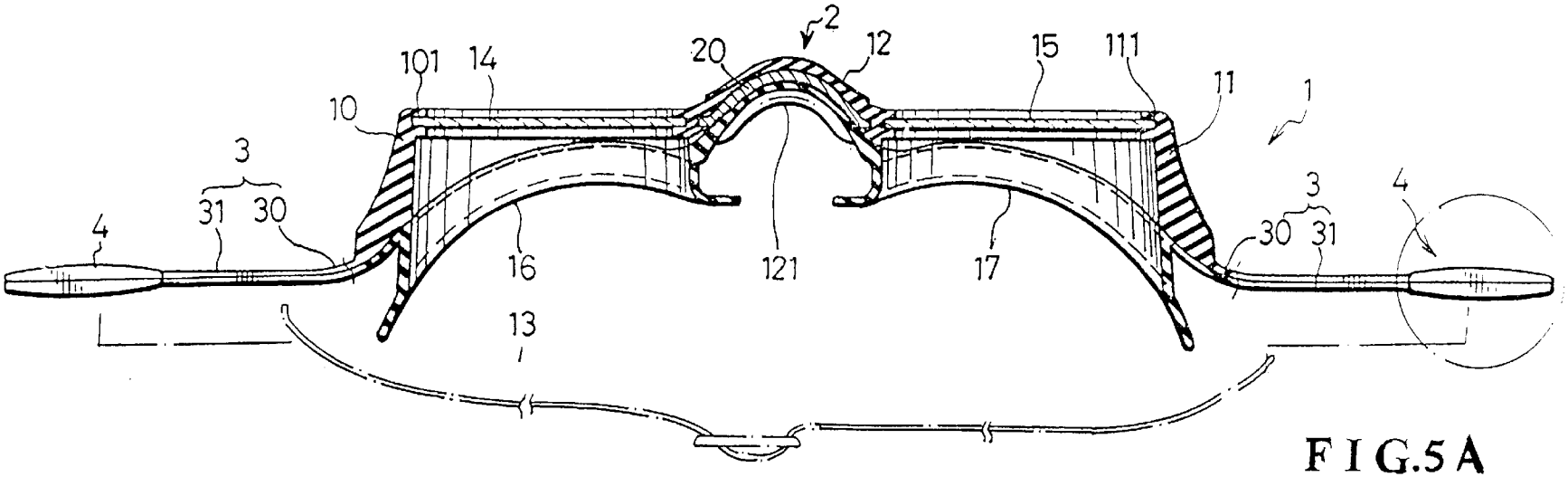
FIG. 5A is a top view, partially broken, showing the first embodiment goggles of the present invention.

With reference to the drawings and in particular to FIGS. 4 and 5A, wherein a goggle structure in accordance with a first embodiment of the present invention, generally designated with reference numeral 1, is shown, the goggle structure comprises two lens frames 10 and 11 with a bridge 12 connected between an inner side of the frames 10 and 11 and a head strip 13 (see FIG. 5A) connected between an outer side of the frames 10 and 11. Each of the lens frames 10 and 11 has a lens 14 or 15 fixed therein and a gasket 16 or 17 extending along the lens frame. The frames 10 and 11 have inner flanges 101 and 111 for holding the lenses 14 and 15.

Figure 5B:
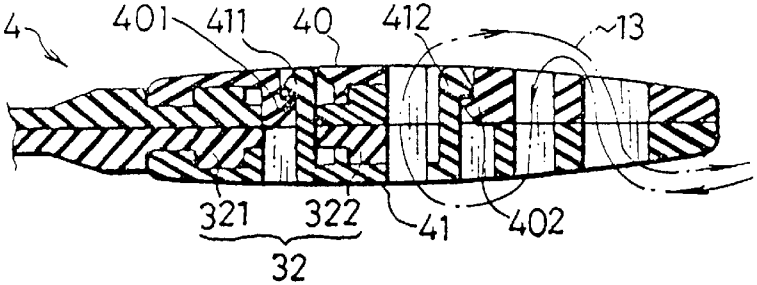
FIG. 5B is an enlarged, cross-sectional view of the circled portion of FIG. 5A.
Figure 5C:
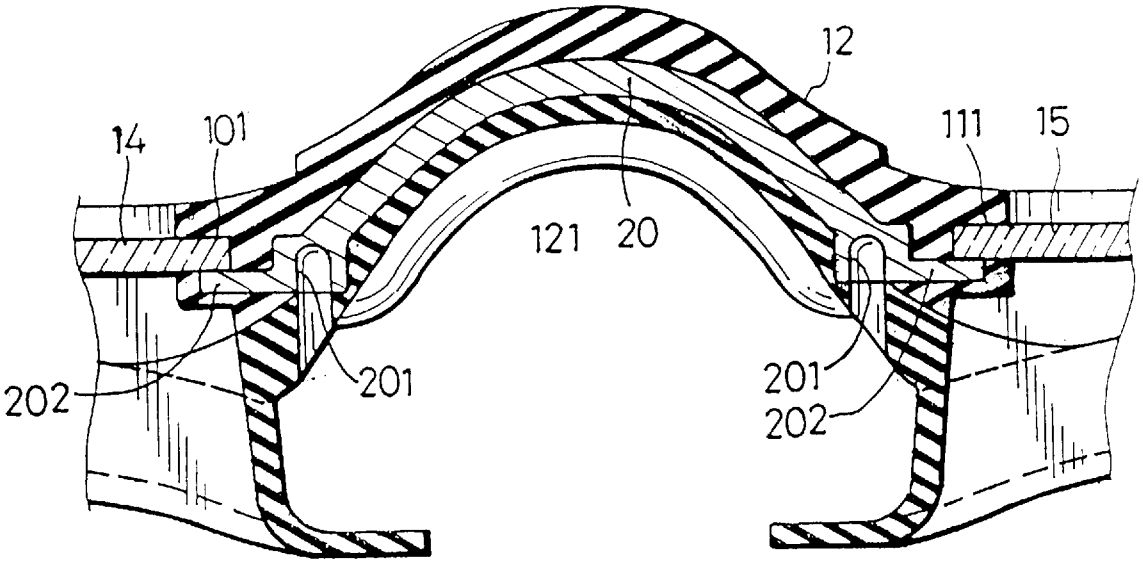
FIG. 5C is an enlarged, cross-sectional view of the bridge of the first embodiment goggles of the present invention.

With particular to FIG. 5C, the bridge 12 comprises a nose contour conforming means 2 mounted thereto. The nose contour conforming means 2 comprises a bendable insert 20. Preferably, the bendable insert 20 is in the form of a plate made of a material which is capable of plastic deformation embedded within the bridge 12 and more preferably, the bridge 12 is molded so as to embed the bendable insert 20 therein to form an integral bendable bridge structure.

Suitable materials for making the bendable insert 20 include, but not limited to, deformable metal sheets or plates, such as copper or copper based alloys, aluminum or aluminum based alloys; plastic-deformable rubber materials, such as natural rubber and synthetic rubbers, for example silicon rubber; and plastic materials, such as injection moldable plastics, for example polyvinylchloride (PVC), polypropylene (PP) and nylon.

Figure 7:
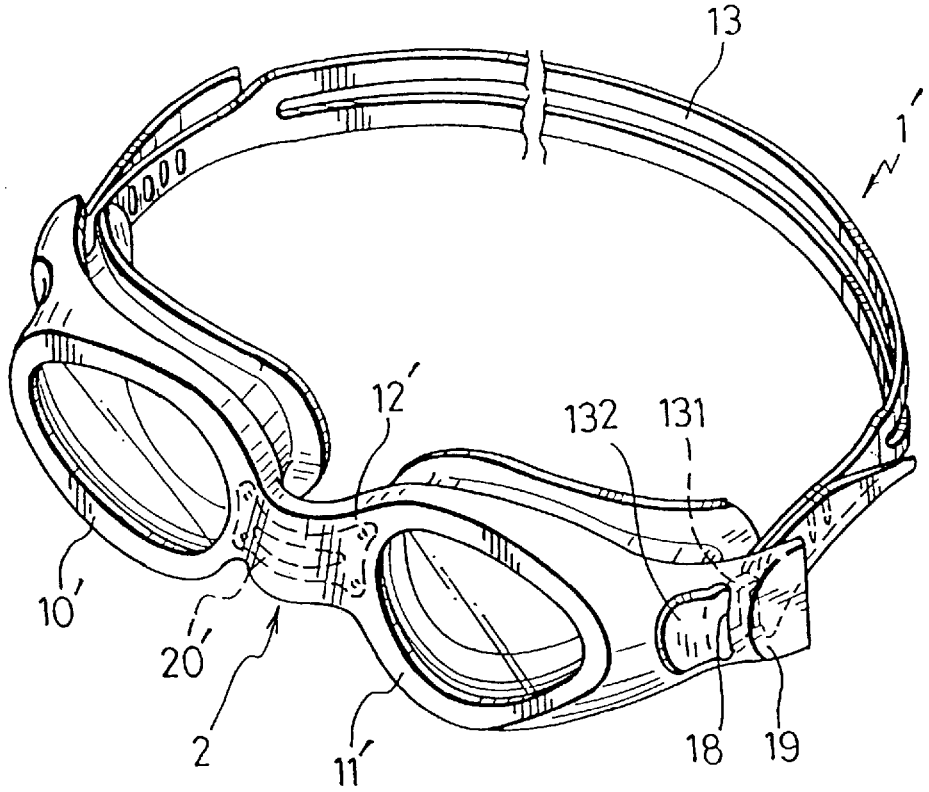
FIG. 7 is a perspective view showing goggles constructed in accordance a third embodiment of the present invention.

The bendable insert 20 may be a hollow frame like plate as best seen in FIG. 7. An inward projection 121, serving as a nose cushion pad, in the form of a concave arc extends inward from the hollow portion of the insert 20 to provide resilient contact between the bridge 12 and the wearer's nose (not shown).

In accordance with the present invention, preferably, the frames 10 and 11, the bridge 12 and the gaskets 16 and 17 are made as a single piece of an injection moldable material with injection molding technique. In order to hold the embedded insert 20 in position during the molding process, the bendable insert 20 is provided with a plurality of pin holes 201 into which pins provided on a molding die (not shown) are insertable to hold the insert 20 in position during the molding process. In the embodiments illustrated, there are four such pin holes 201 provided on the insert 20, see FIG. 7.

To more securely hold the insert 20 in position in order to prevent the insert 20 from being moved by the turbulence of the injected, fluid-like material in the molding process, it is preferable to provide an extension 202 located outside the pin holes 201 to rest against the lenses 14 and 15. The insert 20 is then securely held in position by being pushed by the molding die from one side thereof to be tightly against the lenses 14 and 15.

Referring to FIG. 5A, the frames 10 and 11 have stretching release means 3 mounted to the outer side thereof to reduce or release the stretching force acting upon the bridge 12 and the frames 10 and 11 in wearing the goggles. The stretching release means 3 comprises an inner segment 30 extending from the outer side of each of the frames 10 and 11, a middle segment 31 connected to the inner segment 30 and an outer segment 32 connected to the middle segment 31. The inner segment 30 takes the form of an arc having an end integrally formed on and extending from the respective frame 10 or 11 and an opposite free end from which the middle segment 31 extends. The middle segment 31 may comprise a plurality of dimples (not shown) to increase the resistance to the stretching force. The outer segment 32 extends from the middle segment 31 and comprises two steps 321 and 322 formed thereon, see FIG. 5B. A fastener 4 for connecting the head strip 13 is provided on the outer segment 32.

Figure 5D:
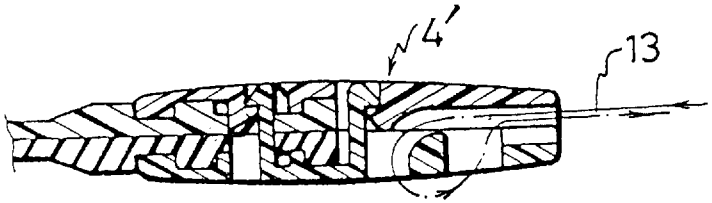
FIG. 5D is a cross-sectional view of the circled portion of FIG. 5A, showing a structure different from that shown in FIG. 5B.

With reference to FIG. 5B, the fastener 4 comprises two members 40 and 41 fixed together to sandwich the outer segment 32 therebetween. The two fastener members 40 and 41 comprise catch and paw pairs 401, 411 and 402, 412 to engage each other for securing the two members 40 and 41 together. Preferably, the outer segment 32 is provided with a through hole into which one of the catch and paw pairs 401, 411 extends to more securely fix the fastener 4 to the outer segment 32. The fastener 4 is also provided with slots or openings for receiving and engaging the head strip 13 therethrough as indicated by the arrows shown in FIG. 5B. The strip receiving slots or openings of the fastener 4 may be modified to another form, designated 4' in FIG. 5D, which provides the same function of connecting the head strip 13 to the fastener 4. In FIG. 5D, arrows are also shown to indicate the way to extend the head strip 13 through the strip receiving slots of the fastener 4'.

Quite obviously, the goggle structure in accordance with the present invention comprises a bendable insert 20 and/or a nose cushion pad 121 which allow the goggles 1, particularly the bridge 12 of the goggles 1, to be bent to any desired contour to conform to the nose contour of a wearer so as to make the wearer comfortable. Thus, the present invention allows the goggles to be formed integrally as a single piece with a soft material which provides a better conformability around the wearer's face without losing resistance to stretching in wearing the goggles.

Figure 6A:
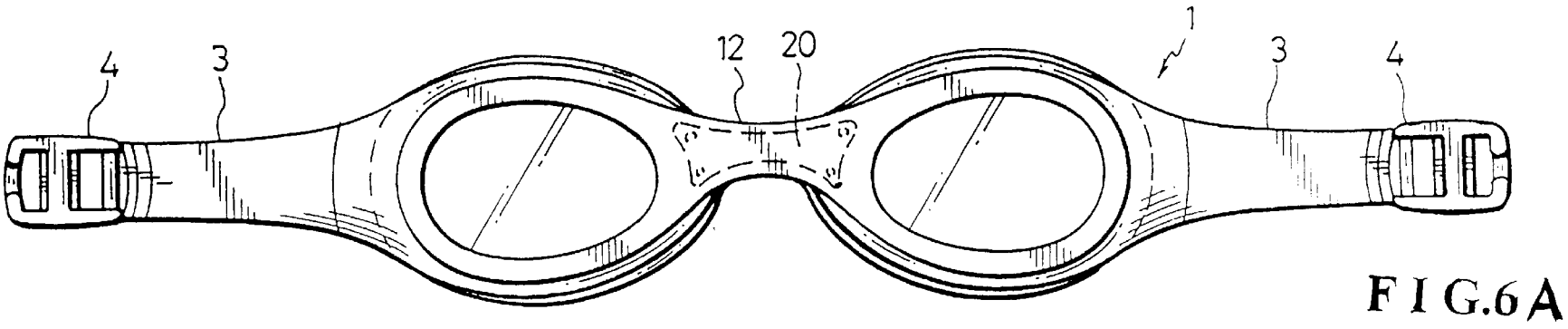
FIG. 6A is a front view of goggles constructed in accordance with a second embodiment in accordance with the present invention.
Figure 6B:
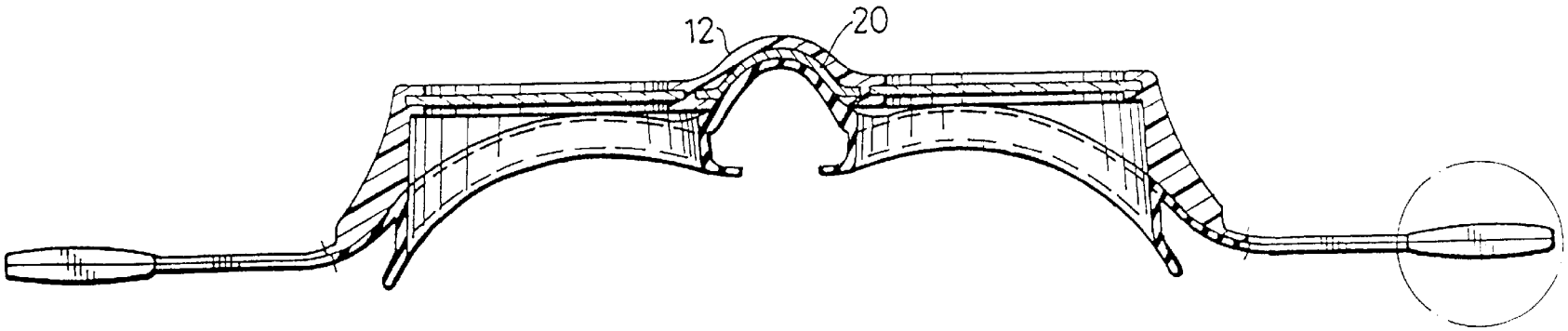
FIG. 6B is a top view, partially broken, showing the second embodiment goggles of the present invention.

With reference to FIGS. 6A and 6B, wherein goggles constructed in accordance with a second embodiment of the present invention is shown, the second embodiment goggles have a structure quite similar to the first embodiment with only difference is that the nose cushion pad 121 is removed. In other words, only the insert plate 20 is embedded in the bridge 12 to provides the conformity to the nose contour. Same reference numerals are used to represent the same parts or elements in both the first and second embodiments.

FIG. 7 shows goggles constructed in accordance with a third embodiment of the present invention, which is generally designated with the reference numeral 1'. The goggles 1' have two frames 10' and 11' with a bridge 12' connected between inner sides thereof and a head strip 13 connected between outer sides thereof. The bridge 12' has nose contour conforming means 2 mounted thereon which in the embodiment illustrated comprises a hollow frame like bendable insert 20' embedded in the bridge 12'. The frames 10' and 11' comprise a connecting hole 18 formed thereon and a constraining projection 19 extending from the frames 10' or 11' and located outboard the hole 18. The head strip 13 comprises a U-shaped fastener 131 associated with each of the connecting holes 18, having a retaining tab 132 mounted thereto to retain the fastener 131 to the respective connecting hole 18.

Although preferred embodiments of the present invention have been described to illustrate the present invention, it is apparent that changes and modifications in the preferred embodiments can be carried out with out departing from the scope of the invention which is intended to be limited only by the appended claims.

What is claimed is:

1. A swimming goggle structure comprising:

two lens frames each having a lens fixed therein with a bridge between inner sides of the frames, wherein the bridge comprises a bendable insert embedded therein and substantially extending across the bridge to provide conformity of the bridge to a wearer's nose contour, each of the frames has a connecting hole formed thereon and a constraining projection located outboard the connecting hole and extending from the frame, and wherein the swimming goggle structure further comprises a head strip having a fastener mounted thereto to engage the connecting hole for securing the head strip to the frames.

2. The swimming goggle structure as claimed in claim 1, wherein the bendable insert is made of a metal material selected from the group consisting of copper, copper based alloys, aluminum and aluminum based alloys.

3. The swimming goggle structure as claimed in claim 1, wherein the bendable insert is made of a material selected from the group consisting of natural rubber, silicon rubber and injection-molded polyvinylchloride, polypropylene and nylon.

4. The swimming goggle structure as claimed in claim 1, wherein the bendable insert is a hollow frame-like member having a nose cushion pad extending from the hollow section thereof toward a wearer's nose to provide comfortable contact with the wearer's nose.

5. The swimming goggle structure as claimed in claim 1, wherein each of the frames comprises a gasket extending along the frame.

6. The swimming goggle structure as claimed in claim 5, wherein the frames, the bridge and the gaskets are integrally formed as a single piece.

7. The swimming goggle structure as claimed in claim 5, wherein the frames, the bridge and the gaskets are made as a single piece by means of molding technique and wherein the bendable insert comprises a plurality of positioning holes adapted to receive therein positioning pins of a molding die to hold the bendable insert in position during molding.

8. The swimming goggle structure as claimed in claim 1, wherein the goggle structure further comprises a head strip extending between outer sides of the frames and wherein the outer side of each of the frames comprises stretching release means mounted thereto to connect the head strip, the stretching release means comprising an arcuate inner segment integrally formed on and extending from the outer side of the respective frame, a middle segment connected to a free end of the inner segment and at outer segment extending from the middle segment with a fastener fixed thereon to engage the head strip.

9. A swimming goggle structure comprising:

two lens frames each having a lens fixed therein with a bridge between inner sides of the frames, wherein the bridge comprises a bendable insert embedded therein and substantially extending across the bridge to provide conformity of the bridge to a wearer's nose contour, and wherein each of the frames comprises a gasket extending along the frame, and the frames, the bridge, and the gaskets are molded as an integral unit and wherein the bendable insert comprises a plurality of positioning holes adapted to receive therein positioning pins of a molding die to hold the bendable insert in position during molding.

10. The swimming goggle structure as claimed in claim 9 wherein:

each of the frames has a connecting hole formed thereon and a constraining projection located outboard the connecting hole and extending from the frame, and wherein the swimming goggle structure further comprises a head strip having a fastener mounted thereto to engage the connecting hole for securing the head strip to the frames.

* * * * *